US008217887B2

(12) United States Patent
Sangam et al.

(10) Patent No.: US 8,217,887 B2
(45) Date of Patent: Jul. 10, 2012

(54) SYSTEM AND METHOD FOR BACKLIGHT CONTROL FOR AN ELECTRONIC DISPLAY

(75) Inventors: Dilip Sangam, Saratoga, CA (US); Hendrik Santo, San Jose, CA (US); Tushar Dhayagude, Santa Clara, CA (US); Klen Vi, Palo Alto, CA (US); Sean Chen, Sunnyvale, CA (US)

(73) Assignee: Atmel Corporation, San Jose, CA (US)

( * ) Notice: Subject to any disclaimer, the term of this patent is extended or adjusted under 35 U.S.C. 154(b) by 945 days.

(21) Appl. No.: 12/018,399

(22) Filed: Jan. 23, 2008

(65) Prior Publication Data

US 2009/0184904 A1 Jul. 23, 2009

(51) Int. Cl.
*G09G 3/36* (2006.01)

(52) U.S. Cl. ..... 345/102; 345/82

(58) Field of Classification Search ..... 345/102, 345/83

See application file for complete search history.

(56) References Cited

U.S. PATENT DOCUMENTS

| | | | | |
|---|---|---|---|---|
| 5,850,205 | A | 12/1998 | Blouin | |
| 2002/0118321 | A1 | 8/2002 | Ge | |
| 2002/0180719 | A1* | 12/2002 | Nagai et al. | 345/206 |
| 2005/0046704 | A1* | 3/2005 | Kinoshita | 348/226.1 |
| 2005/0231457 | A1* | 10/2005 | Yamamoto et al. | 345/102 |
| 2006/0001641 | A1 | 1/2006 | Degwekar | |
| 2007/0216638 | A1* | 9/2007 | Kojima | 345/102 |
| 2007/0262732 | A1 | 11/2007 | Shen | |
| 2007/0285378 | A1 | 12/2007 | Lankhorst et al. | |

OTHER PUBLICATIONS

International Search Report and Written Opinion for PCT Application No. PCT/US09/31705, 10 pages.

* cited by examiner

*Primary Examiner* — Kevin M Nguyen
*Assistant Examiner* — Sepideh Ghafari
(74) *Attorney, Agent, or Firm* — Fish & Richardson P.C.

(57) ABSTRACT

The present invention discloses apparatus and techniques relating to the intelligent control of a display's backlight LED strings. The present invention provides for controlling the display intensity on a region-by-region basis and for adjusting the intensity multiple times within the duration of a frame. The present invention also provides backlight adjustment in a manner that emphasizes certain colors and deemphasizes certain colors. The present invention also provides for adjustment of the backlight based on the ambient temperature.

21 Claims, 3 Drawing Sheets

SYSTEM AND METHOD FOR BACKLIGHT CONTROL FOR AN ELECTRONIC DISPLAY

FIELD OF INVENTION

The present invention relates to electronic display technology, and particularly to controlling the intensity of light emitting diodes (LEDs) in the backlights of electronic displays.

BACKGROUND OF THE INVENTION

Backlights are used to illuminate thick and thin film displays including liquid crystal displays (LCDs). LCDs with backlights are used in small displays for cell phones and personal digital assistants (PDAs), as well as in large displays for computer monitors and televisions. Typically, the light source for the backlight includes one or more cold cathode fluorescent lamps (CCFLs). The light source for the backlight can also be an incandescent light bulb, an electroluminescent panel (ELP), or one or more hot cathode fluorescent lamps (HCFLs).

The display industry is enthusiastically pursuing the use of LEDs as the light source in the backlight technology because CCFLs have many shortcomings: they do not easily ignite in cold temperatures, require adequate idle time to ignite, and require delicate handling. LEDs generally have a higher ratio of light generated to power consumed than the other backlight sources. So, displays with LED backlights consume less power than other displays.

LEDs are also advantageous over CCFLs because they require a very short period of time, for example, around one hundred nano-seconds, to switch from full dim to full bright. CCFLs, HCFLs and incandescent lamps can require more than a millisecond to switch from full dim to full bright. LED backlighting has traditionally been used in small, inexpensive LCD panels. However, LED backlighting is becoming more common in large displays such as those used for computers and televisions. In large displays, multiple LEDs are required to provide adequate backlight for the LCD display.

With the proliferation of inexpensive LCD displays of various sizes, displays are being used in a multitude of applications. For example, LCD displays are now commonly used in automotive applications in devices such as Global Positioning System (GPS) devices and entertainment systems like televisions and DVD players.

To control the intensity of the LED backlight, pulse-width modulation (PWM) is often used. PWM of a signal or power source involves the modulation of its duty cycle, to control the amount of power sent to a load. PWM uses a square wave whose duty cycle is modulated resulting in the variation of the average value of the waveform. PWM alternates between a high voltage that causes the emission of bright light and a low voltage that does not cause the emission of light, instead of providing a continuous voltage to the LED for causing a continuous output of a certain intensity of light.

In PWM, the LED switches quickly enough that the human eye does not perceive the on and off states, but instead perceives an intensity of light that depends on the duration of the on state. Presently, the adjustments to the backlighting are made independently of the images being displayed by the pixel circuitry. For example, a laptop is typically factory set to provide only two different levels of brightness: a higher level of brightness during the full power mode and a lower level of brightness during the battery power mode. Some prior art also discloses adjusting the backlight intensity at the beginning of each frame (see U.S. Pat. No. 7,138,974).

In video production, animation, and related fields, a frame is one of the many still images which compose the complete moving picture. Prior to the development of digital video technology, frames were recorded on a long strip of photographic film, and each image looked rather like a framed picture when examined individually, hence the name. When the moving picture is displayed, each frame is flashed on a screen for a short time (usually 1/24th, 1/25th or 1/30th of a second) and then immediately replaced by the next one. Persistence of vision blends the frames together, producing the illusion of a moving image. The video frame is also sometimes used as a unit of time, being variously 1/24, 1/25 or 1/30 of a second, so that a momentary event might be said to last 6 frames. The frame rate, the rate at which sequential frames are presented, varies according to the video standard in use. In North America and Japan, 30 frames per second is the broadcast standard, with 24 frames per second now common in production for high-definition video. In much of the rest of the world, the rate of 25 frames per second is standard.

This frame-by-frame backlight control of the prior art, in which the backlight is adjusted only once for each frame, has several deficiencies. For example, when a very dark image immediately follows a bright image, the frame-by-frame control technique can result in undesired visual artifacts. Similarly, for the frame in which one portion of the displayed image is bright and another portion is dark, the frame-by-frame control technique can result in undesired visual artifacts. The apparatus and techniques of the present invention overcome these deficiencies and provide other unique features.

SUMMARY OF THE INVENTION

The present invention provides novel apparatus and techniques for controlling backlighting of a display. According to one aspect of the present invention, the intensity of the backlight is adjusted multiple times within the duration of a frame. This feature provides additional flexibility in setting the luminosity of the display and also provides the ability to male a gradual transition between the luminosities of two successive frames, for example, from a bright frame to a dark frame. In another aspect of the present invention, the display is divided into a number of tiles or sections and the backlighting for each tile is separately controlled. This feature provides for superior contrast control across the display. In yet another aspect of the present invention, the backlighting can be adjusted based on ambient lighting and its effect on the perceived colors. The features of the present invention provide for an enhanced contrast ratio for the display, the removal or reduction of visual artifacts, and the flexibility to selectively emphasize and deemphasize colors based on the ambient lighting conditions.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
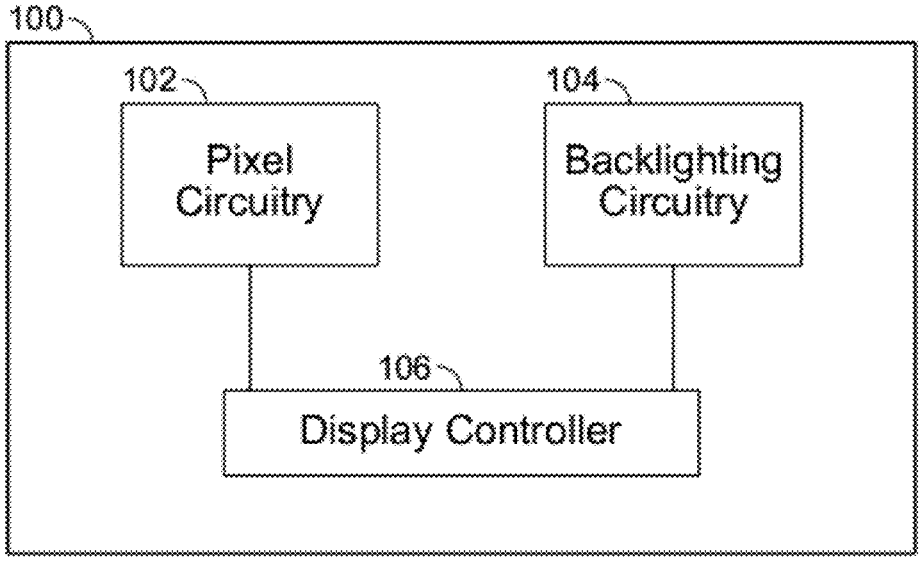
FIG. 1 illustrates a functional block diagram for a display of the present invention.

FIG. 1 illustrates a functional block diagram for a typical display, such as a liquid crystal display (LCD), in which the present invention can be implemented. The display 100 includes a pixel circuitry 102, the backlighting circuitry 104 and the display controller 106. The pixel circuitry 102 includes a large number of pixels, for example, two million pixels, arranged in a matrix of rows and columns across the display. The pixels are used for rendering the image. The pixel circuitry 102 also includes row and column drivers for selecting the pixels and providing image data to the pixels.

The backlighting circuitry 104 includes a number of strings of light emitting diodes (LEDS) arranged across the display 100. Typically, each string is coupled to a power supply on one end and to the ground on the other end. Preferably, each string of LEDs includes either red, blue or green LEDs. The LED strings can be selectively turned on and off for providing the various desired colors. The pixel circuitry 102 and the backlighting circuitry 104 are controlled by the display controller 106. The display controller 106 is a part of the system controller of the product that houses the display, for example, the television set or the laptop computer, and is provided by the product manufacturer.

The display controller 106 can be either a general purposes microcomputer or a special purpose microcomputer. The display controller 106 can be implemented on a single integrated circuit (IC) chip or on multiple IC chips. The display controller 106 can be programmable or non-programmable. The display controller 106 can be implemented in hardware, software or firmware.

Figure 2:
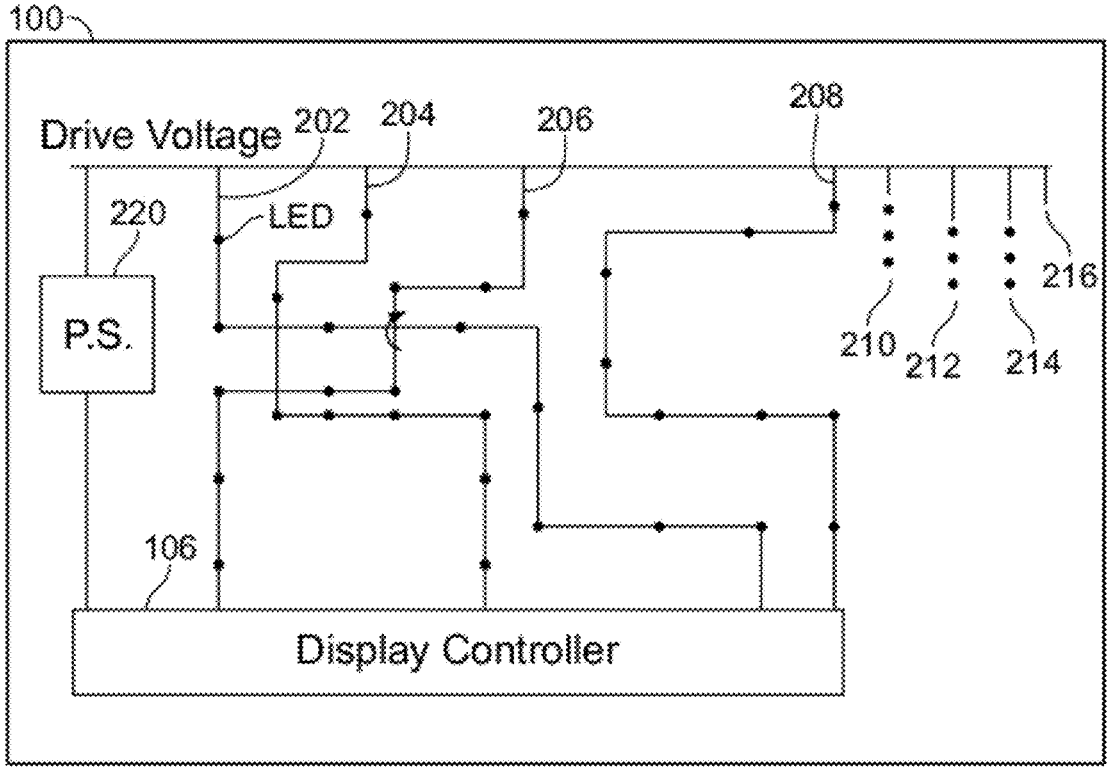
FIG. 2 illustrates an exemplary backlighting system of the present invention.

FIG. 2 illustrates an exemplary backlighting system 104 having eight LED strings 202, 204, 206, 208, 210, 212, 214 and 216. The LED strings 202, 204, 206 and 208 include green LEDS. The LED strings 210 and 212 include red LEDS. The LED strings 214 and 216 include blue LEDS. Each string 202, 204, 206, 208, 210, 212, 214 or 216 can include eight, ten or other number of LEDs. The display controller 106 receives a feedback signal from the LED strings 202, 204, 206, 208, 210, 212, 214 and 216 and uses it to control the power supply 220 that provides the drive voltage for the LED strings 202, 204, 206, 208, 210, 212, 214 and 216. In the preferred embodiment of the present invention, LEDs are implemented in packages, with each package having some red, some blue and some green LEDs. Also, in the preferred embodiment of the present invention, each string only includes LEDs of a particular color. Thus, in the preferred embodiment of FIG. 2, the LED strings of various colors are intertwined.

In typical television and computer systems, the display controller uses the display controller 106 uses HSYNC and VSYNC signals to control the pixel circuitry 104. Display apparatus must show around thirty frames per second so as to form moving images by virtue of persistence of vision inhuman eyes. Each frame includes a plurality of scan lines, and each scan line includes a plurality of pixels. Thus image signals received by the pixel circuitry 104 from an image processing system, by way of the display controller 106, include data corresponding to a series of pixels.

In order to ensure that the display controller 106 can locate the position corresponding to each pixel data, aside from the pixel data, the image processing system provides the display controller 106 with a horizontal synchronization (HSYNC) signal to indicate the start of a scan line, and a vertical synchronization (VSYNC) signal to indicate the start of a frame. The HSYNC and VSYNC signals are essentially clock signals. In one embodiment, a start of a new scan line and the start of a new frame can be triggered by the rising edges (i.e., the change from a low level state to a high level state) of the timing pulses of the HSYNC and VSYNC signals, respectively.

In that embodiment, when the display controller 106 detects the rising edge of one of the timing pulses of the HSYNC signal, the subsequent pixel data received thereby will be interpreted as those belonging to the next scan line, and when the display controller 106 detects the rising edge of one of the timing pulses of the VSYNC signal, the subsequent pixel data received thereby will be interpreted as those belonging to the next frame. In this manner, image signals can be decoded and displayed correctly in sequence. One of ordinary skill in the will appreciate that in another embodiment, falling edges of the HSYNC and VSYNC pulses can be used by the display controller 106 to initiate a new scan lines and a new frame, respectively.

Figure 3:
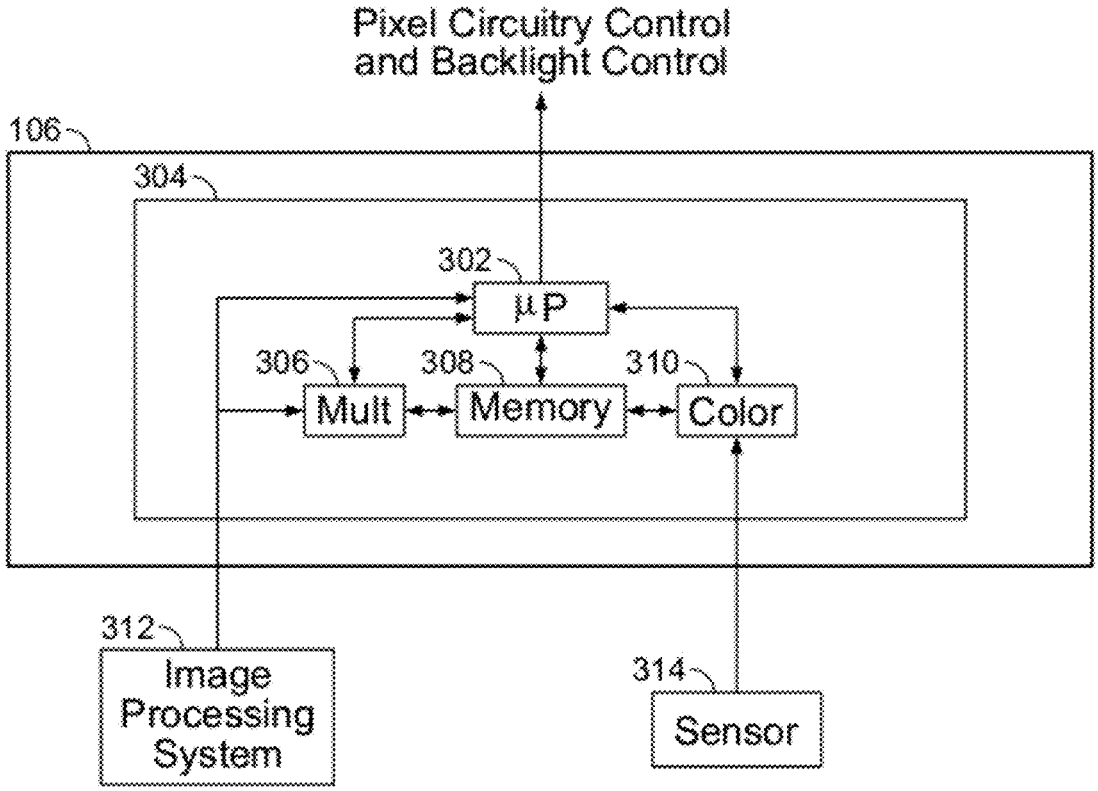
FIG. 3 illustrates an exemplary functional block diagram of control circuitry of the present invention.

FIG. 3 illustrates an exemplary functional block diagram for the display controller 106 of the present invention. The display controller 106 includes a microcomputer 304. The microcontroller 304 includes a microprocessor 302 coupled to the multiplication circuitry, the memory 308 and the color circuitry 310. The microprocessor 302 can be a general purpose microprocessor or a special purpose microprocessor and can be programmable or non-programmable. The memory 308 is coupled to the multiplication circuitry 306 and the color circuitry 310.

The memory 308 can be random access memory (RAM), read only memory (ROM), a cache, a buffer, a temporary storage, registers, dynamic memory, or the like. The memory 308 is coupled to the multiplication circuitry 306 and the color circuitry 310. The multiplication circuitry 306 is configured to generate a clock signal having frequency that is a multiple of a reference frequency. The multiplication circuitry 306 can be implemented in hardware, software or firmware. The multiplication circuitry can be programmable or non programmable. In one embodiment, the multiplier value can user programmable. In another embodiment, the multiplier value can be permanently set in the factory. In yet another example, the multiplier value can be set on the fly, or adjusted periodically, by considering factors such as the variation in the luminosity of the frames to be displayed and the ambient lighting conditions.

Figure 4:
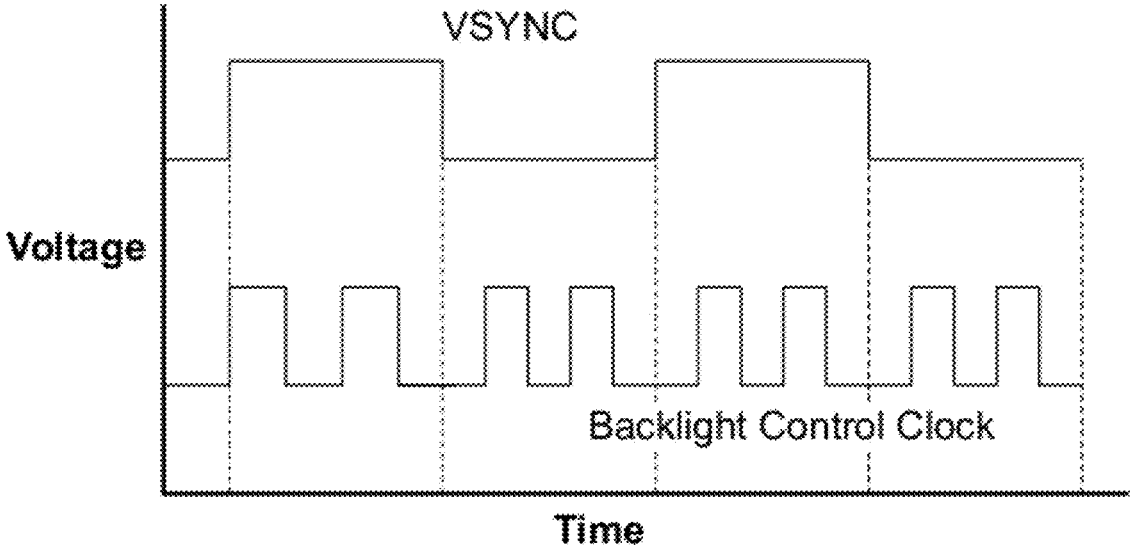
FIG. 4 illustrates exemplary waveforms of the present invention.

In one embodiment, the image processing system 312 provides the VSYNC signal to the multiplier circuitry 306, as a reference signal, either directly or by way of the microprocessor 302. In another embodiment, the VSYNC frequency is programmed into the multiplier circuitry 306 or the microprocessor 302. The multiplier circuitry generates a clock signal, referred hereinafter as the backlight control clock, having a frequency that is a multiple of the VSYNC signal frequency. In one embodiment, the backlight control clock has a frequency that is an integer multiple of the VSYNC signal frequency, for example, 2, 3, 4, 5, 10, 12, 15 or 20 times larger than the VSYNC signal frequency. In one embodiment, the backlight control clock has a frequency that is a fraction of the VSYNC signal frequency. In one embodiment, the backlight control clock has a frequency that is an non-integer multiple of the VSYNC signal frequency, for example, 2.3, 3.6, 4.1, 4.5, 10.3, 10.6, 15.4 or 20.3 times larger than the VSYNC signal frequency. FIG. 4 illustrates an exemplary backlight control clock of the present invention, in which the backlight control clock has twice the frequency of the VSYNC signal.

The microprocessor 302 uses the backlight control clock to control the strings 202-216 of the backlight circuitry 104. Specifically, the microprocessor 302 adjusts the luminosities of the strings 202-216 at the frequency of the backlight control clock. In one embodiment, the microprocessor 302 adjusts the luminosities of the strings 202-216 at the rising edge of each pulse of the backlight control clock. In one embodiment, the microprocessor 302 adjusts the luminosities of the strings 202-216 at the falling edge of each pulse of the backlight control clock. In one embodiment, the microprocessor 302 adjusts the luminosities of the strings 202-216 during the high voltage portion of each pulse of the backlight control clock. In one embodiment, the microprocessor 302 adjusts the luminosities of the strings 202-216 during the low voltage portion of each pulse of the backlight control clock.

The luminosities of the strings 202-216 are adjusted by changing the drive voltages and drive currents of the strings 202-216. By way of example, if the backlight control clock has twice the frequency of the VSYNC signal, the luminosities of the strings 202-216 will be adjusted twice during the rendering of each frame. Therefore, if a dark frame follows a bright frame, the microprocessor 302 can reduce the luminosity of the strings 202-216 half way through the rendering of the bright frame, thereby causing a visually smoother transition to the dark frame by removing or reducing the visual artifacts that would have caused by the immediate switch from the bright frame to the dark frame.

The techniques of the present invention can be used to provide blanking intervals during the operation of the display. During the blanking intervals, the backlighting is turned off. For example, in a video frame, during the raster blanking period, during which the image is refreshed (also known as blanking interval), the backlight unit needs to be blanked so that there are no visual artifacts. This happens naturally in a CRT monitor where the phosphor stores the light energy which decays slowly and the image is completely dark during the blanking interval. The present invention accomplishes the blanking intervals for LCD monitors by using synchronization to provide blanking during portions of a video frame by shutting down the backlight unit. This also reduces power consumption in the backlight unit and improves its efficiency.

In FIG. 3, the sensor 314 is shown coupled to the color circuitry 310. The sensor 314 is an ambient light sensor. The color circuitry 310 can be an intelligent and programmable unit implemented in hardware, firmware or software. The color circuitry 310 can be a part of the microprocessor 302 or a separate unit coupled to the microprocessor 302. In one aspect of the present invention, the color circuitry 310 is configured to determine if a certain color or certain colors should be displayed with higher or lower levels of luminosities, to provide a better color contrast ratio. For example, certain ambient light condition might male it difficult for the viewer to differentiate between two similar colors. Under those conditions, the color circuitry 310 might be programmed to analyze, for example, that some or all strings of the green LEDs should be displayed at a higher luminosity level than the strings of the red LEDs, to provide a better color contrast ratio.

An example of a room with ambient lighting could be a conference room with video conferencing capability, where the color of the ambient light is altered to get the best performance for the video camera. This room would potentially have around 30-40% of the visible color gamut (up to 60% of NTSC (National Television System Committee color gamut) and will require color compensation from the LCD panel to make the colors look natural. This backlight scheme of the present invention can be used to enhance the color spectrum to 100% to 110% of NTSC color gamut.

Figure 5:
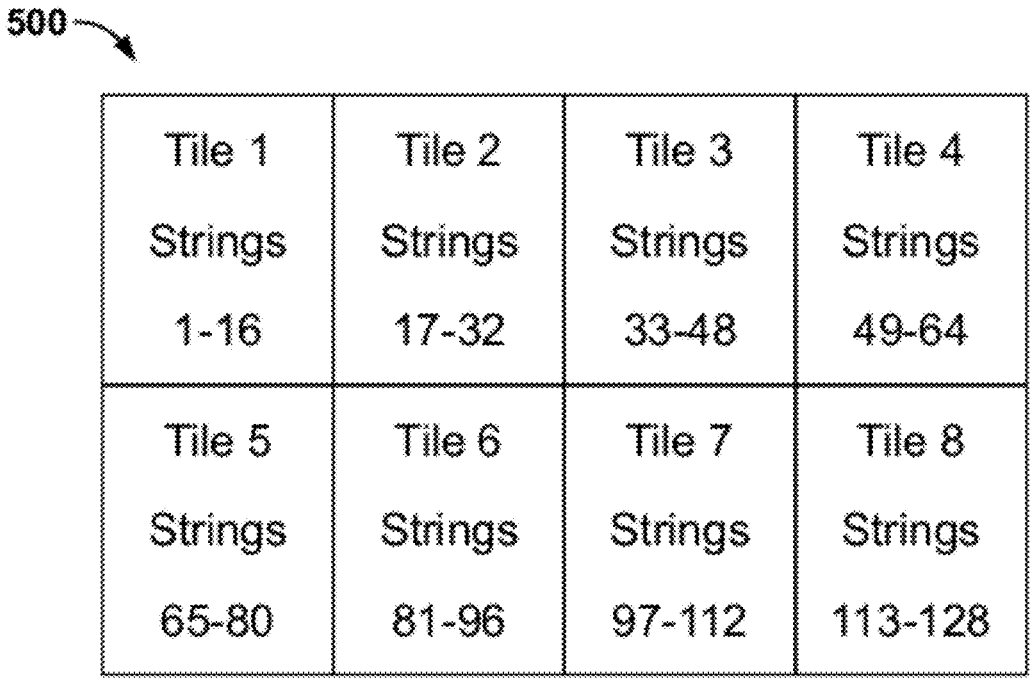
FIG. 5 illustrates an exemplary backlighting system arrangement of the present invention.

FIG. 5 illustrates an exemplary embodiment of the display 500 of the present invention, in which the display 500 is divided into eight tiles. Each tile includes a number of strings of LEDs. Tile 1 includes LED strings 1-16, tile 2 includes LED strings 17-32, tile 3 includes LED strings 33-48, tile 4 includes LED strings 49-64, tile 5 includes LED strings 65-80, tile 6 includes LED strings 81-96, tile 7 includes LED strings 97-112 and tile 8 includes LED strings 113-128. Preferably, each tile includes a mixture of the strings of red, blue and green LEDs.

Figure 6:
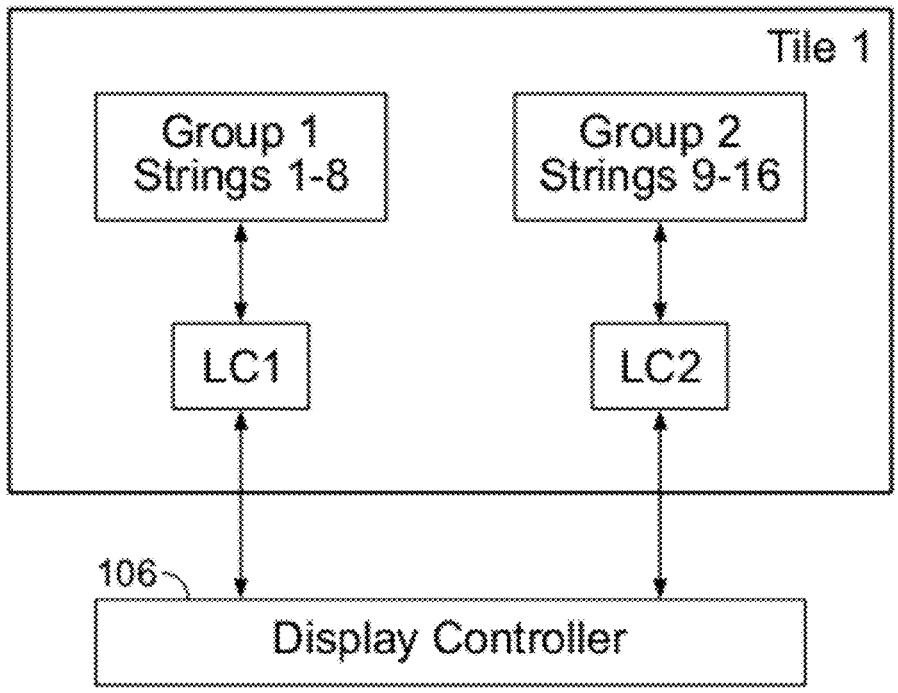
FIG. 6 illustrates an exemplary functional block diagram of control circuitry of the present invention.

FIG. 6 illustrates an exemplary functional block diagram for controlling backlighting in tile 1 of the display of the present invention. The 16 LED strings of tile 1 are shown divided into two groups: group 1 having strings 1-8 and group 2 having strings 9-16. In other embodiments, the strings 1-16 of tile 1 can be divided into various numbers of groups or not be divided at all. The strings 1-8 of group 1 are coupled to the local controller 1 (LC1) and the strings 9-16 of group 2 are coupled to the local controller 2 (LC2). LC1 and LC2 integrated circuit chips are coupled to display controller 106.

The embodiments of FIGS. 5 and 6 of the present invention provide for a regional control of the display 500. LC1 and LC2 can be programmable modules, each including a multiplier circuit, a microprocessor, color circuitry and memory for generating its own backlight control signal for controlling backlighting of the portion for tile 1 to which it is assigned.

One of ordinary skill in the art will appreciate that the techniques, structures and methods of the present invention above are exemplary. The present inventions can be implemented in various embodiments without deviating from the scope of the invention.

The invention claimed is:

1. A control circuit for an electronic display comprising:

a first circuitry for controlling luminosity levels of a plurality of strings of light emitting diodes (LEDs);

a second circuitry for controlling a plurality of pixels for displaying a plurality of image frames of a video;

the second circuitry for displaying each image frame of the plurality of image frames for a predetermined period of time, the second circuitry configured to change a displayed image frame once every cycle of a first clock signal having a first frequency; and the first circuitry for adjusting the luminosity levels of the plurality of strings of LEDs for a plurality of times within the predetermined period of time, the first circuitry configured to adjust the luminosity levels according to a second clock signal having a second frequency that is a multiple of the first frequency and is higher than the first frequency.

2. The control circuit of claim 1, wherein the predetermined period of time includes approximately 1/30 seconds.

3. The control circuit of claim 1, wherein the plurality of times includes a number selected from a set of one, two, three, four, five, six, seven, eight, nine and ten.

4. The control circuit of claim 1, wherein the first clock signal is a VSYNC signal, and the predetermined period of time is a period of time between two successive rising edges of pulses of the VSYNC signal.

5. The control circuit of claim 1, wherein the first clock signal is a VSYNC signal, and the first circuitry configured to adjust the luminosity levels of the plurality of LED strings for a plurality of times between an occurrence of two successive pulses of a VSYNC signal.

6. The control circuit of claim 1, wherein the plurality of strings of LEDs include a string of red LEDs, a string of blue LEDs and a string of green LEDs.

7. The control circuit of claim 1, the display further comprising:

a first display section associated with a first set of pixels of the plurality of pixels;

a second display section associated with a second set of pixels of the plurality of pixels;

a first set of strings of the plurality of strings associated with the first section;

a second set of strings of the plurality of strings associated with the second section;

the first circuitry configured to adjust luminosity levels of the first set of strings according to a portion of an image frame being displayed by the first set of pixels and to adjust luminosity levels of the second set of strings according to a portion of the image frame being displayed by the second set of pixels.

8. The control circuit of claim 1, further comprising:

an ambient light sensor coupled to the first circuitry; and the first circuitry configured for adjusting the luminosity levels of the plurality of strings of LEDs based on ambient lighting conditions.

9. The control circuit of claim 8, wherein the first circuitry is configured to adjust a luminosity level of a red string of LEDs to a different luminosity level from a luminosity level of a green string of LEDs.

10. The control circuit of claim 1, wherein the display includes a liquid crystal display.

11. The control circuit of claim 1, further comprising:

the first circuitry for causing the luminosity levels of the plurality of strings of LEDs to become zero during a raster blanking interval.

12. The control circuit of claim 1, wherein the plurality of strings of LEDs include a combination of a string of white LEDs and one or more strings of LEDs selected from the group consisting of a string of red LEDs, a string of blue LEDs, or a string of green LEDs.

13. A method for controlling an electronic display comprising:

generating a clock signal having a frequency that is a multiple of a reference frequency by multiplying a reference signal having the reference frequency, the frequency being higher than the reference frequency;

changing a displayed image frame on the electronic display once every cycle of the reference signal; and using the clock signal for adjusting luminosity levels of a plurality of strings of light emitting diodes (LEDs) in a backlighting circuitry of the electronic display, wherein luminosity levels of at least one of the plurality of strings of LEDs are adjusted a plurality of times based on the clock signal during display of one image frame in a sequence of image frames.

14. The method of claim 13, wherein the reference frequency includes a frequency of a VSYNC signal.

15. The method of claim 13, wherein adjusting the luminosity levels of a string of LEDs includes adjusting the luminosity levels at the frequency of the clock signal.

16. The method of claim 15, wherein adjusting the luminosity levels of the string of LEDs is based on a color of the LEDs and an ambient light condition.

17. A liquid crystal display comprising:

a plurality of strings of light emitting diodes (LEDs) including a string of red LEDs, a string of green LEDs and a string of blue LEDs;

a first circuitry for controlling luminosity levels of the plurality of strings of LEDs;

a plurality of pixels for displaying a plurality of image frames of a video;

a second circuitry for controlling the plurality of pixels;

the second circuitry for displaying each image frame of the plurality of image frames for a predetermined period of time determined by a frequency of a VSYNC signal having a first frequency, the second circuitry configured to change a displayed image frame once every cycle of the VSYNC signal; and the first circuitry for adjusting the luminosity levels of the plurality of strings of LEDs for a plurality of times within the predetermined period of time, the first circuitry configured to adjust the luminosity levels according to a second clock signal having a second frequency that is a multiple of the first frequency and is higher than the first frequency.

18. The display of claim 17, wherein the predetermined period of time includes approximately 1/30 seconds.

19. The display of claim 17, wherein the plurality of times includes a number selected from a set of one, two, three, four, five, six, seven, eight, nine and ten.

20. The display of claim 17, wherein the first circuitry is configured to generate the second clock signal.

21. The display of claim 17, wherein the first circuitry for adjusting a luminosity level of the string of red LEDs to a different luminosity level from a luminosity level of the string of blue LEDs based upon an ambient light condition.

* * * * *

UNITED STATES PATENT AND TRADEMARK OFFICE

CERTIFICATE OF CORRECTION

PATENT NO. : 8,217,887 B2
APPLICATION NO. : 12/018399
DATED : July 10, 2012
INVENTOR(S) : Dilip Sangam et al.

It is certified that error appears in the above-identified patent and that said Letters Patent is hereby corrected as shown below:

Cover Page, Column 1, item (75) Inventors: delete "Klen" and insert -- Kien --

Column 2, Line 40 delete "male" and insert -- make --

Column 5, Line 56 delete "male" and insert -- make --

Signed and Sealed this
Twenty-first Day of August, 2012

David J. Kappos

David J. Kappos
*Director of the United States Patent and Trademark Office*